US005163486A

United States Patent [19]

Rogers et al.

[11] Patent Number: 5,163,486

[45] Date of Patent: Nov. 17, 1992

[54] CLEANING SYSTEM FOR PARTICULATE PRODUCTS HANDLING EQUIPMENT

[75] Inventors: Peter J. Rogers; James E. Chapin; William E. Zinkie; Bruce A. Blair, all of Cobourg, Canada

[73] Assignee: Kraft General Foods Canada Inc., Don Mills, Canada

[21] Appl. No.: 702,980

[22] Filed: May 20, 1991

[51] Int. Cl.[5] ..... B65B 31/00

[52] U.S. Cl. ..... 141/89; 141/91; 134/95.1; 134/166 C; 134/169 C; 134/95.2

[58] Field of Search ..... 141/85, 89–92; 134/95, 166 R, 166 C, 169 R, 169 C

[56] References Cited

U.S. PATENT DOCUMENTS

| | | | |
|---|---|---|---|
| 3,831,848 | 8/1974 | Cook | 134/95 X |
| 3,912,535 | 10/1975 | Rausér | 134/95 X |
| 4,167,193 | 11/1979 | Magnus et al. | 134/95 |
| 4,318,431 | 3/1982 | Evans | 141/90 |
| 4,989,649 | 2/1991 | Weiler et al. | 141/1 |

FOREIGN PATENT DOCUMENTS

| | | | |
|---|---|---|---|
| 1042622 | 11/1978 | Canada | 134/169 C |

*Primary Examiner*—Ernest G. Cusick
*Attorney, Agent, or Firm*—Linn I. Grim

[57] ABSTRACT

A clean in place system for a system handling a flow of dry particulate or powder products therethrough, which includes a plurality of flow conduits through which the dry product flows. A plurality of spray nozzles are strategically placed within the system, and include a plurality of flush mounted spray nozzles mounted flush along the interior walls of the flow conduits, and several barrel spray nozzles mounted within the system. One barrel spray nozzle is supported by and below a mounting plate which during a cleaning operation is placed temporarily over a top aperture in a vibrating hopper of a tote table, and is removed therefrom after the cleaning operation is completed. Additional barrel flow nozzles are mounted within filler hoppers of the pouch filling system. A vacuum system is provided for removing air and any dry product carried therewith, and includes vacuum conduits coupled near the base of the system. A drain system is provided for removing water and any product carried therewith, and also includes drain conduits coupled near the base of the system, and the vacuum and drain conduits are alternately coupled to common removal outlets at the product filler auger outlets of the pouch filling system. A control system first introduces compressed air to be sprayed through the plurality of spray nozzles to dislodge and blow clean any dry product in the system. The vacuum system removes the sprayed compressed air and any dry product carried thereby. Secondly, water is sprayed through the plurality of spray nozzles to wash and flush away any dry product remaining in the system after completion of the first air spraying operation. The drain system removes the sprayed water and dry product carried therewith. Thirdly, compressed air is sprayed through the plurality of spray nozzles to evaporate any water remaining after the second water spraying step and to dry the system.

17 Claims, 6 Drawing Sheets

CLS/CIP CONTROL PANELS

UPSTAIRS PANEL

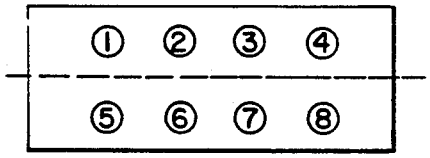

| | NAME | COLOR/TYPE |
|---|---|---|
| ① | "CIS SYSTEM" SWITCH | OFF-ON |
| ② | "SYSTEM EMPTY" LIGHT | |
| ③ | "DUMP SUGAR" LIGHT | |
| ④ | "DUMP PRODUCT" LIGHT | |
| ⑤ | "TOTE TABLE READY" SWITCH | OFF-ON |
| ⑥ | SPARE (POSSIBLE VERIFICATION LIGHT FOR SWITCH AT 5 | |
| ⑦ | "WET COMPLETE" LIGHT | |
| ⑧ | "DRY COMPLETE" LIGHT | |

DOWNSTAIRS PANEL

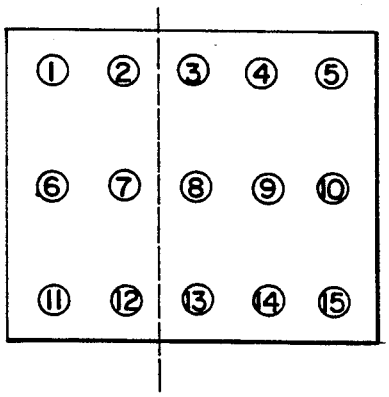

| | | |
|---|---|---|
| ① | "FILLER A EMPTY" LIGHT | GREEN |
| ② | "FILLER B EMPTY" LIGHT | GREEN |
| ③ | "TOTE TABLE READY" LIGHT | |
| ④ | "VACUUM HOSE" LIGHT | |
| ⑤ | "DRAIN HOSE" LIGHT | |
| ⑥ | SPARE } POSSIBLE VERIFICATION LIGHTS FOR SWITCHES AT 11, 12 | |
| ⑦ | SPARE } POSSIBLE VERIFICATION LIGHTS FOR SWITCHES AT 11, 12 | |
| ⑧ | "BLOW COMPLETE" LIGHT | |
| ⑨ | "WET COMPLETE" LIGHT | |
| ⑩ | "DRY COMPLETE" LIGHT | |
| ⑪ | "DUMP SUGAR" SWITCH | |
| ⑫ | "DUMP PRODUCT" SWITCH | |
| ⑬ | "CIP SYSTEM" KEYED SWITCH | |
| ⑭ | "PROGRAM" SELECTION SWITCH | |
| ⑮ | "CIP START" PUSH BUTTON SWITCH | |

*Fig. 8*

CLEANING SYSTEM FOR PARTICULATE PRODUCTS HANDLING EQUIPMENT

BACKGROUND OF THE INVENTION

1. Field of the Invention

The present invention relates generally to a cleaning system for equipment which handles a flow of particulate or powder products. More particularly, the subject invention pertains to a cleaning system as described for a pouch filling system which dispenses dry particulate or powder products, with relatively frequent changeovers between different types of powder products, each of which requires a thorough cleaning of old product from the system.

2. Discussion of the Prior Art

The current prior art pouch filling system contains multiple locations where powder products consistently accumulate or are trapped, particularly in the areas of the cross augers and filler hoppers. Also, many of the seals in the system are worn, damaged or inadequately designed for sealing powder products, which results in more trapping of powder products, leakage in some areas, and extensive cleaning efforts by all operators.

A wet wash is performed periodically on the system to provide a thorough cleaning thereof. This involves removing key internal components, such as augers and seals, and gaining access to all areas of the system by removing sections such as rubber socks and cover plates. All removed components are washed by hand, and all components not removed are washed using a hot water hose or hand-held wipers. All water sprayed into the piping is collected by wet hoses which are clamped to the exit chute of the cross augers, and wet buckets, which are later dumped into a drain.

Numerous problems are associated with wet washes that must be performed on this system.

The amount of water used and the quality of the cleaning job in every case is entirely dependent upon the particular operator performing the task, so a thorough cleaning cannot always be guaranteed and water wastage is possible.

Many of the locations where powder products are trapped are hidden (e.g. beside the chute connecting the diverter to the top of the filler hopper) or difficult to reach (e.g. the far end of the cross auger tubes). This means that some areas become encrusted with powder that has come into contact with water, but was not washed out of the system. Cleaning those areas now requires the use of a scraper, which can result in damage to components and thus further cleaning and flow characteristic problems.

Also, water leakage occurs through some of the seals in the system in areas above the actual pouch filling area, and thus some external parts of the filler system also become wet during a wet wash.

To summarize, many areas of this system needed significant improvements to speed up the cleaning process and reduce the amount of product that enters the effluent stream, such as completely sealing the filling system and eliminating product accumulation areas.

Clean In Place (CIP) systems are known in the prior art, involve somewhat standardized technology, and are used almost exclusively to clean systems handling liquid based products. A large variety of different clean in place systems in the prior art were evaluated in the development of the present invention, and most of these systems are designed with equipment consisting primarily of tanks, liquid pumps, and piping of less than three inches in diameter. In these systems, cleaning is accomplished by the pressurized flow of steam, water and solvents. Therefore, much of this standardized technology does not apply to equipment for handling particulate or powder products. Several clean in place systems were evaluated which were almost identical to the pouch filling system for which the present clean in place system was developed. In particular, a grated parmesan dispensing line and a dinner cheese mix dispensing line were evaluated. However, unlike the system for which the present clean in place system was developed, those systems run only two or three different products over long periods of time, with very infrequent changeovers. Therefore, changeover downtime is not a large concern, and during cleaning, the systems are completely dismantled and washed.

Dry cleans and sugar flushes have also been utilized in the prior art to clean pouch filling systems. A sugar flush involves running sugar through the pouch filling system to allow the sugar to flush and clean the internal components thereof. Dry cleans represent a medium between sugar flushes and full wet washes, because a sugar flush is conducted but some parts are cleaned by hand as well. A dry clean is substantially identical to a sugar flush except that two additional steps are required:

1. All filling funnels and duck bills are blown clean with compressed air.

2. The filler augers and filler hoppers are dropped down so that the components inside the filler hoppers can be sprayed with compressed air. The cleaned augers and hoppers are then replaced.

Added time is also required to blow clean the duck bills and funnels. However, in general blowing of any parts of the filler system should be avoided because of the product dust that results, causing cleaning difficulties for all lines in the area. The necessity of spraying the filler hoppers creates identical problems.

SUMMARY OF THE INVENTION

In accordance with the teachings herein, the present invention provides a clean in place system for a system handling a flow of dry particulate or powder products therethrough, which includes a plurality of flow conduits through which the dry product flows. Pursuant to the present invention, a plurality of spray nozzles are strategically placed within the plurality of flow conduits. A control system first introduces compressed air to be sprayed through the plurality of spray nozzles to dislodge and blow clean any dry product in the system. A vacuum system is provided for removing the sprayed compressed air and any dry product carried thereby. Secondly, water is sprayed through the plurality of spray nozzles to wash and flush away any dry product remaining in the system after completion of the first air spraying operation. A drain system is provided for removing the sprayed water and dry product carried therewith. Thirdly, compressed air is sprayed through the plurality of spray nozzles to evaporate any water remaining after the second water spraying step and to dry the system, and the compressed air and water are removed through the drain system. The vacuum conduit and drain conduit are preferably coupled to a common removal drain aperture near the base of the system.

In greater particularity, the plurality of spray nozzles includes a plurality of flush mounted spray nozzles mounted flush along the interior walls of the flow conduits, and several spherical or barrel spray nozzles mounted within the system. One spherical spray nozzle is supported by and below a mounting plate which during a cleaning operation is placed temporarily over a top aperture in a vibrating hopper of a tote table, and is removed therefrom after the cleaning operation is completed. A storage rack is positioned adjacent to the tote table to facilitate temporary storage and easy handling of the mounting plate and spherical spray nozzle assembly. A flexible hose is attached to the spherical spray nozzle of the assembly to provide a supply of water and compressed air thereto, while allowing convenient movement thereof between placement on the top plate and placement in the storage rack. Additional spherical flow nozzles are mounted within filler hoppers of the pouch filling system. The vacuum system for removing air and any dry product carried therewith includes vacuum conduits coupled near the base of the system. The drain system for removing water and any product carried therewith also includes drain conduits coupled near the base of the system. During a cleaning operation, the vacuum and drain conduits are alternately coupled to common removal outlets at the product filler auger outlets of the pouch filling system.

In a preferred embodiment, the control system sequences the flow of air or water, in typically a three or four step sequence, first through nozzles located near the top of the system, next through nozzles located at an intermediate height in the system, and finally through nozzles located near the base of the system. In the water spray step, the sequencing operation prevents an overflow of water from all of the nozzles simultaneously overloading the drain conduit and system. The sequencing operation can be carried out after full flow of air or water through all nozzles or independently thereof.

The present invention is designed to provide a clean in place system which:

1. reduces the amount of time and effort required to conduct a complete wash job of the internal components of a pouch filling system;

2. improves sanitation for the internal components of the pouch filling system;

3. significantly reduces the current amount of sugar and flavor that enters the effluent stream of the plant during a wet wash of the pouch filling system; and 4. provides a system with flexibility to allow for easy experimentation with different cleaning methods for different product-to-product changes.

The designed system is intended to operate while minimizing the amount of coloring and sugar that leaves the system when water is used so that the BOD (Biological Oxygen Demand) levels of the water are kept to an absolute minimum. To remove powder that is blown out of the system, vacuum hoses are clamped to each of the four filler auger outlets. To remove water, drain hoses are clamped to the same locations. Compressed air used to dry the system also flows into the drain hoses.

The clean in place system is particularly designed to automatically wash/dry the pouch filling center on a packaging machine, particularly a Bartelt packaging machine, and is utilized primarily for product-to-product changeovers, and dramatically reduces cleaning time from 6 hours to 30 minutes. However, the clean in place system also has applications to other cleaning operations, such as periodic dry cleanings and sugar flush cleanings.

During operation of the present invention, for a complete and thorough cleaning of the system, as might be required when a new product is quite dissimilar from the previous product (e.g. chocolate pudding followed by vanilla pudding), the following three cleaning steps are generally performed in the following order:

Step 1: Compressed air is blown through all of a plurality of strategically placed internal nozzles to dislodge and allow the removal of most of the powder product in the pouch filling center. The air can also be selectively sequenced through the nozzles to dislodge any remaining powder. During this first step, all dislodged powder and residue is removed through vacuum outlets by vacuum hoses attached near the bases of the pouch filling center.

Step 2: The vacuum hoses are replaced with drain hoses which are attached to the same outlets. Water at approximately 180° F. is then sprayed through the nozzles to flush all surfaces. This step can spray water through all of the nozzles simultaneously, or in a sequenced operation starting with the nozzles at the top of the pouch filling center and progressively operating the nozzles towards the base of the pouch filling center, or by a combination of simultaneous and sequenced spraying operations. The water exits by the outlet and drain hoses to a drain in the floor.

Step 3: Compressed air, for the second time, is then blown through all of the nozzles to remove all traces of water in the shortest possible time. The water is removed by the same drain hose as used in the wash cycle.

With the three cleaning steps completed, a new product may be loaded into the pouch filling system for packaging.

During operation of the present invention, for a less thorough cleaning of the system, as might be required when a new product is quite similar to the previous product (e.g. strawberry gelatin followed by raspberry gelatin), the following abbreviated cleaning process can be performed. Compressed air is blown through all of a plurality of strategically placed internal nozzles to dislodge and allow the removal of most of the powder product in the pouch filling center. The air is selectively sequenced through the nozzles, first through nozzles at the top of the system, next through intermediate level nozzles, and finally through spray nozzles located near the base of the system, to dislodge any remaining powder. All dislodged powder and residue is removed through vacuum outlets by vacuum hoses attached near the bases of the pouch filling center.

A Cleaning Light System (CLS) is also provided to inform packaging operators of the present status and phase of the clean in place system. The light panel alerts the operators when to initiate the clean in place system, what stage is running, and upon completion of cleaning.

BRIEF DESCRIPTION OF THE DRAWINGS

The foregoing objects and advantages of the present invention for a cleaning system for particulate products handling equipment may be more readily understood by one skilled in the art with reference being had to the following detailed description of several preferred embodiments thereof, taken in conjunction with the accompanying drawings wherein like elements are designated by identical reference numerals throughout the several views, and in which:

FIG. 8 illustrates panels of a cleaning light system which informs packaging operators of the present status and phase of the clean in place system.

DETAILED DESCRIPTION OF THE DRAWINGS

The pouch filling system for which the present clean in place system was developed is unique in that it runs a large number of relatively low volume powder products, such as desserts, puddings, gelatins, etc. and therefore requires a large number of quick changeovers, each requiring a cleaning of the system before a new product powder is introduced therein. The design of the clean in place system design described herein was chosen to achieve quick changeovers on the line, and to allow a reasonable amount of changes in the cleaning parameters (length of time, sequences, etc.) to determine the best parameters for the desired cleaning effort and allowable downtimes.

Figure 1:
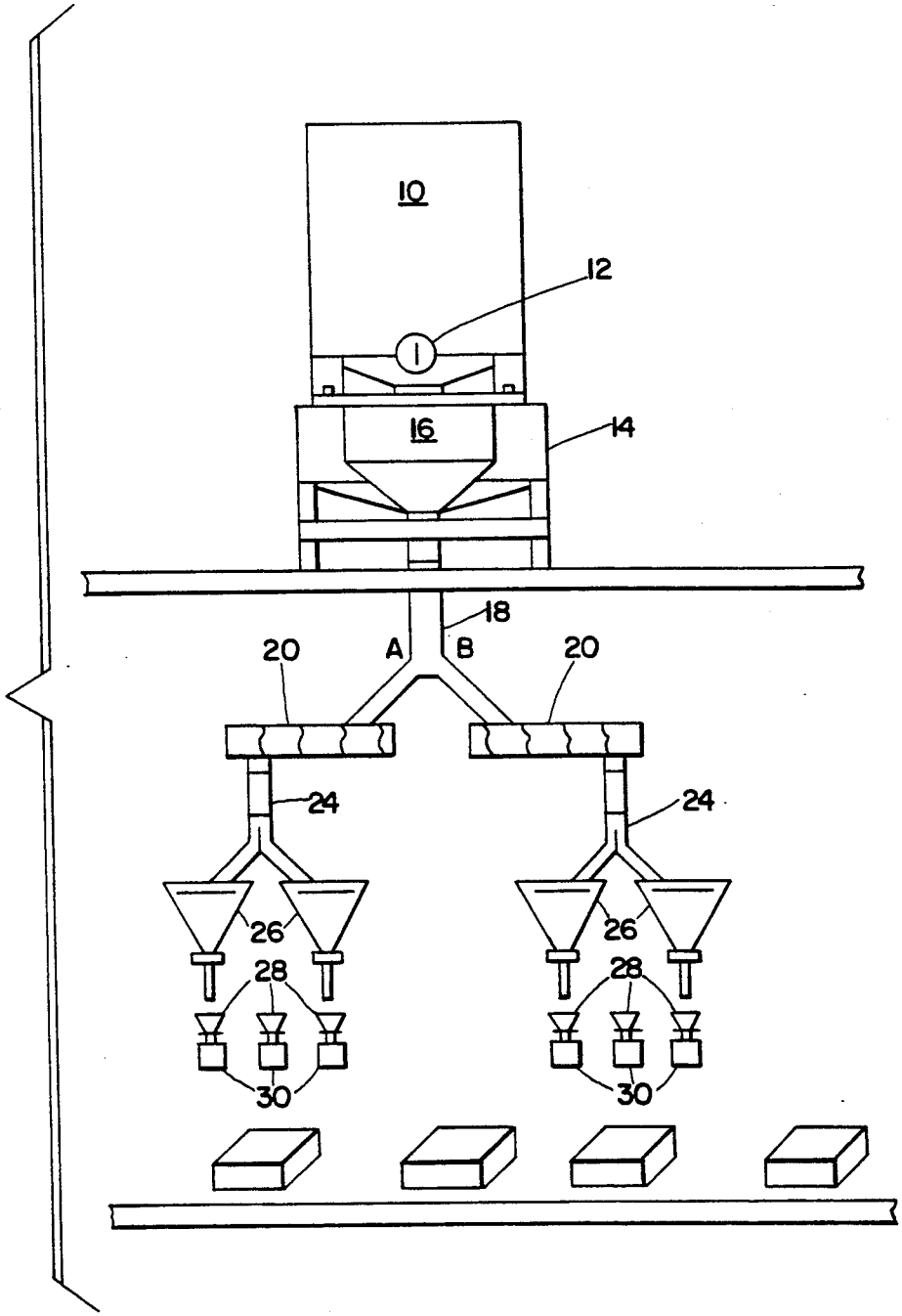
FIG. 1 illustrates a complete pouch filling system which is cleaned with the clean in place system of the present invention.

FIG. 1 illustrates a complete pouch filling system which is cleaned with the clean in place system of the present invention, and which extends between two floors. On the top floor, a tote bin 10 having an eight inch butterfly valve 12 in the bottom thereof, and containing for instance a dry granular or powder product to be dispensed, is mounted on top of a tote table 14. The tote table 14 is a vibrating table to assist in promoting the movement of the dry product through the system. The product flows from the tote bin 10 through the butterfly valve 12 to a tote table hopper 16, through a magnetic trap in the bottom of the hopper 16, to a Y-split element 18 which extends through the floor, and basically divides the flow of material in half to two symmetrically arranged Bartelt packaging machines. Each half of the Y-split 18 feeds a cross auger 20 which moves the product horizontally to its end, from which it flows to a product diverter element 24 which splits and diverts the flow of material to two Bartelt filler hoppers 26, from which material is drawn by an internal auger to flow through duck bills 28 to fill individual pouches 30, all in a somewhat standard manner of operation for a filling system.

The first stage of the design process involved locating and designing out all product traps and accumulation areas in the product filling system. This included avoiding the use of seals where possible. As a result, the design includes a completely new Y-split and cross augers, and modifications to several other areas, including the magnet trap, diverter and filler hoppers.

The second stage was to choose the locations for the air/water nozzles and the types of nozzles required. Only two types of nozzles were chosen for this system, keg washing (spherical spray) nozzles, used to clean the tote table and filler hoppers, flush/wall mount nozzles used to clean the Y-splits and cross augers. Each nozzle is capable of spraying both water and air, so that any nozzle mounted permanently in the system can be cleared of water by running air through it before a new product is introduced into the filling system. Appropriate nozzles are commercially available from Spraying Systems, or John Brooks Ltd., 1260 Kamato Rd., Mississauga, Ontario, Canada.

The third stage was to determine the precise manner of system operation during a changeover.

Figure 2:
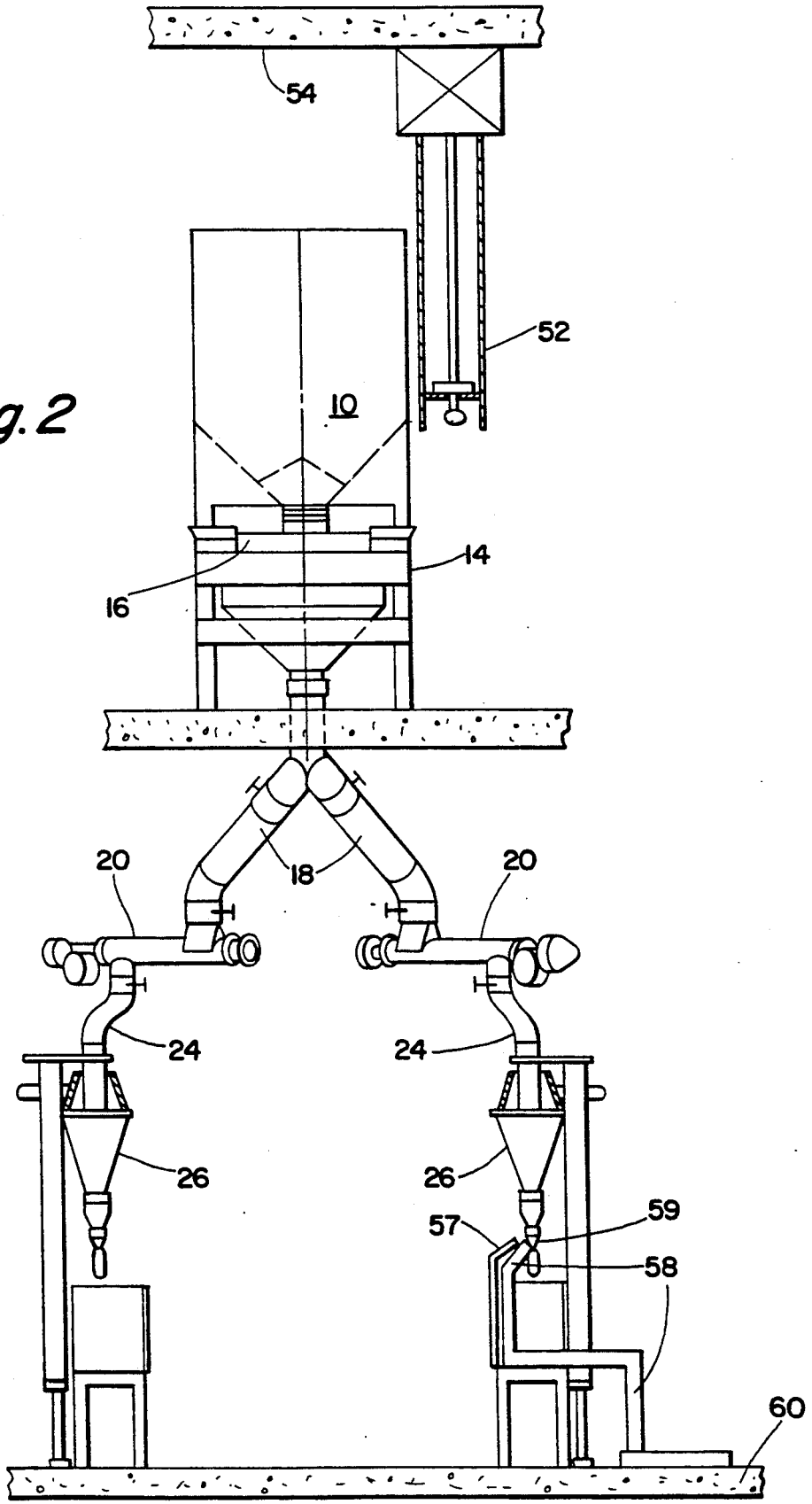
FIG. 2 illustrates a more detailed and schematic view of the pouch filling system and the details of the clean in place system of the present invention.
Figure 3:
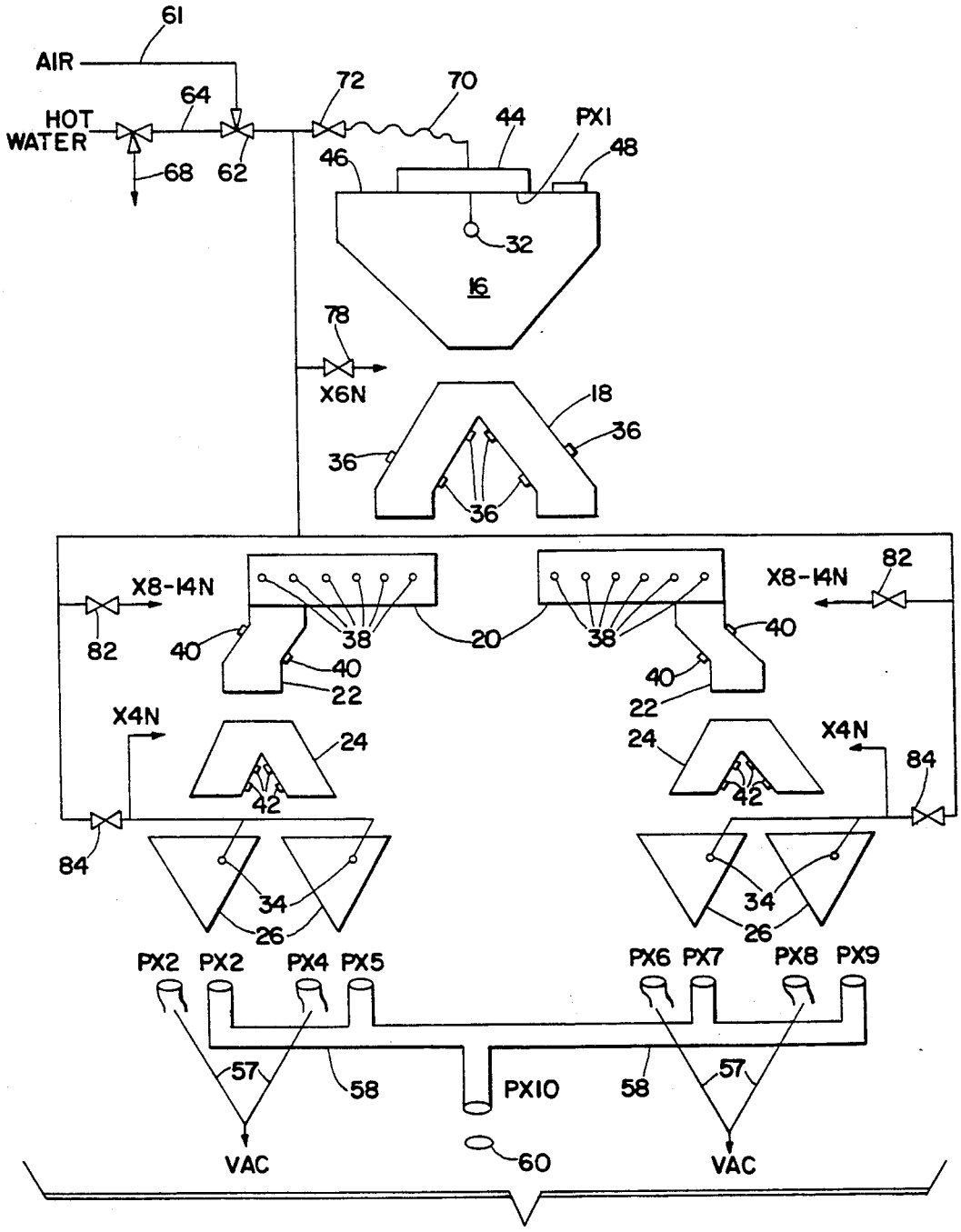
FIG. 3 is a somewhat exploded view of the major components of the pouch filling system of FIG. 1, and illustrates the placement of spray nozzles pursuant to the clean in place system of the subject invention.

FIG. 2 illustrates a more detailed and schematic view of the pouch filling system and details of the clean in place system of the present invention, while FIG. 3 is a somewhat exploded view of the major components of the pouch filling system. As illustrated therein, the clean in place system of the present invention includes one keg or spherical spray nozzle 32 removably mounted within the tote table bin 16, four keg or spherical spray nozzles 34, one mounted in place within each of the four product filler hoppers 26, typically six flush mounted internal spray nozzles 36 mounted in the Y-split element (two spaced along the inner side and one placed near the outer bottom side of each leg of the Y-split), typically six to twelve spray nozzles 38 mounted along opposite sides of each of the cross augers 20, typically two spray nozzles 40 positioned on opposite sides of the product exit chute 22 of each cross auger, and typically four flush mounted internal spray nozzles 42 mounted on opposite inner sides of each leg of each product diverter 24.

To reduce the number of tasks required to set up the clean in place system for operation, all but one of the nozzles are semi-permanently placed, meaning that they can be left in place during normal production, but are still removable for contamination checks during a regular weekly cleaning program. These nozzles experience negligible clogging with product and any product entering the nozzles or tubing is easily cleaned out once air and water are injected into the tubing. The only nozzle that is not semi-permanently mounted is the keg washing nozzle 32, which is attached to a cover plate 44 that can be quickly placed over the tote table top plate 46. The cover plate 44 can be removed once drying has commenced, since the natural tendency of the water will be to evaporate upwardly.

Figure 4:
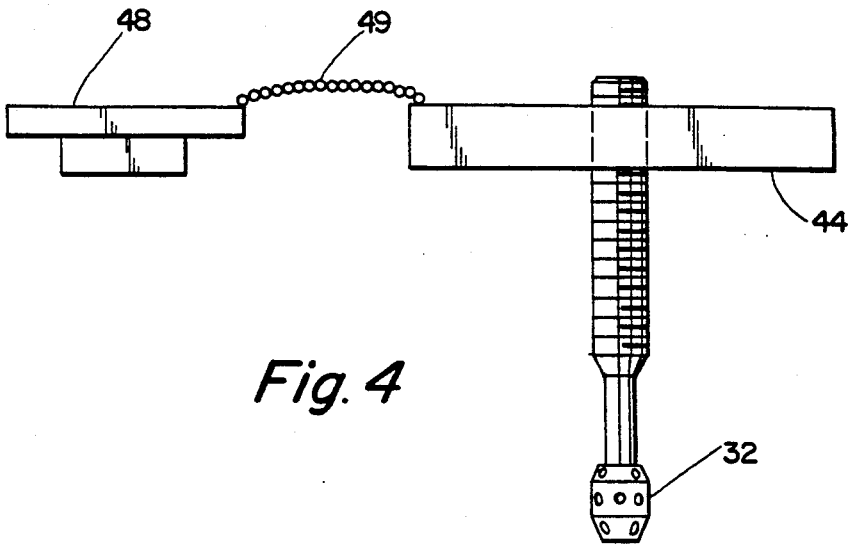
FIG. 4 is a side elevational view of the ball valve and mounting plate for cleaning the tote table hopper.

FIG. 4 is a side elevational view of an assembly of a circular metal wash plate 44 with a keg washing spray nozzle 32 attached therebelow. When no cleaning operations are being performed, the assembly is placed in a convenient rack 52, FIG. 2, mounted to and below the ceiling 54 such that it is positioned on the side of the tote table for easy access. The metal wash plate and keg spray nozzle assembly is attached to a flexible hose 70 to provide a supply of water and compressed air thereto, while allowing convenient movement thereof between placement on the top plate and placement in the storage rack. The metal wash plate 44 is removed from the rack at the beginning of a cleaning operation, and placed over an eight inch opening in the top cover plate 46 of the tote table hopper without removing the cover plate therefrom. A plug 48 is also attached as by a chain 49 to the wash plate 44, and is utilized during the cleaning operation to seal a vent opening in the top plate of the tote table hopper. During operation, the keg nozzle sprays in all directions (360 degrees) and thoroughly cleans the underside and inside of the tote table. The water temperature is approximately 180 degrees for improved cleaning of starch and gelatin therefrom. When the wash cycle is completed, the spray nozzle assembly is returned to the convenient rack 52 at the side of the tote table and a tote bin is then placed on top.

With respect to the Y-split element 18, the clean in place system implements the following improvements. The Y-split 18 has typically six wide angle spray nozzles 36 mounted around the Y-split element (two spaced along the inner side and one placed near the outer bottom side of each leg of the Y-split). These nozzles are used to clean the portion of the Y-split that the water sprayed from the keg spray nozzle 32 in the tote table hopper 16 normally misses. Also, they will be used to decrease the drying time by passing air therethrough. At the two ends of the Y-split, a straight piece is incorporated that slides into a sleeve on the cross auger. The seal is sufficiently tight that powder product does not enter in between the sleeves. This method of attaching the cross auger to the Y-split reduces the amount of time for removal of one from the other.

Figure 5:
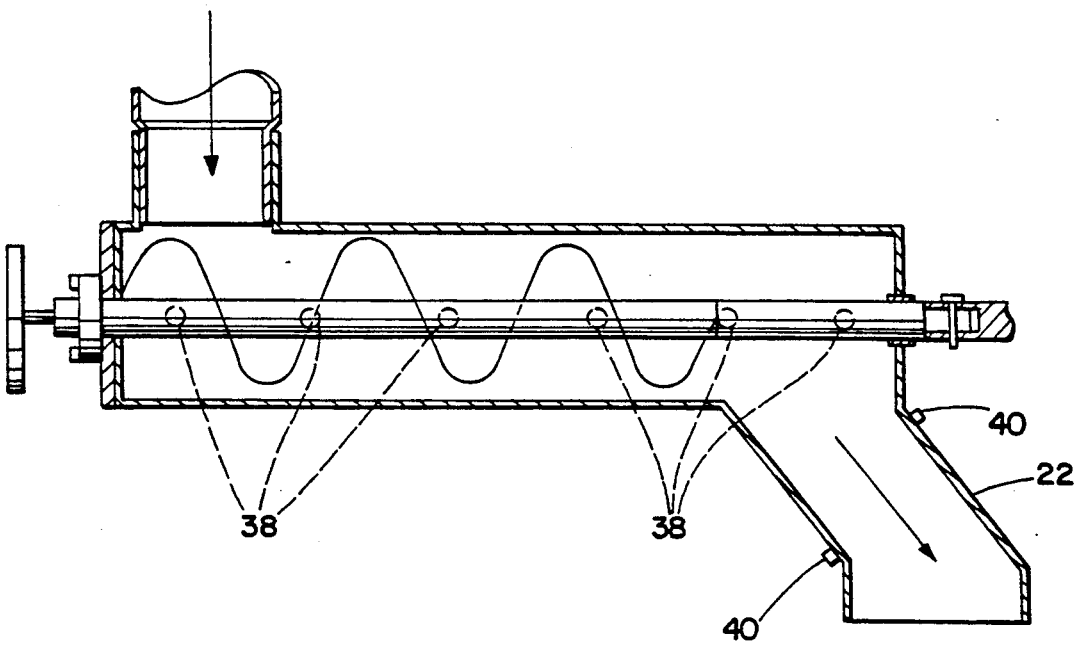
FIG. 5 is a sectional view of one of the cross augers, and illustrates the internal details thereof and also the placement of the flush mounted spray nozzles therein.

FIG. 5 is a sectional view of one of the cross augers 20, and illustrates the internal details thereof and also the placement of the flush mounted spray nozzles therein. As indicated by FIG. 3, typically three to six internally mounted flush nozzles 38 are placed along each opposite side of the auger, which is thus equipped with six or twelve nozzles spaced along both sides thereof. Typically two flush mounted spray nozzles 40 are placed on opposite sides of the exhaust duct 22 of each cross auger.

With respect to the cross auger, the clean in place system implements the following improvements. The cross auger assembly was redesigned to eliminate all areas where product is normally trapped or accumulates. The wide angle full spray nozzles 38 and 40 as described hereinabove are incorporated therein for washing and drying.

The dicerter elements 24 were redesigned to eliminate areas where product is normally trapped or accumulates, and has four spray nozzles 42 spaced along the inner side of each leg thereof, as shown in FIG. 3.

Figure 6:
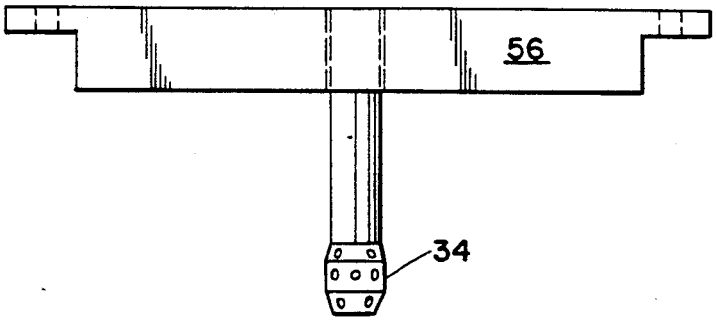
FIG. 6 is a side elevational view of the ball valve and top plate of the filler hopper illustrating the construction thereof.

FIG. 6 is a side elevational view of the ball spray nozzle 34 and top inspection plate 56 of each filler hopper 26 illustrating the construction thereof. The keg spray nozzle 34 is semi-permanently mounted to extend approximately three inches below the top cover plate of each of the four filler hoppers.

With respect to each filler hopper 26, the clean in place system redesigned the filler hopper to eliminate areas where product is normally trapped or accumulates. An air exhaust filter is to be changed weekly, thereby decreasing chance of product buildup and cross contamination. The filler hopper auger which fits into the extension shaft is another place where product accumulates. The filler hopper auger was redesigned with a reverse thread, stopping product from accumulating above the auger. The spherical spray washing nozzle 26 attached to the inspection plate 56 on top of the filler hopper cleans all areas inside the filler hopper and drys the hopper with air after the cleaning cycle.

The vacuum system for removing air and any dry product carried therewith includes vacuum conduits 57 coupled to the product filler auger outlets 59 at the base of the system. The drain system for removing water and any product carried therewith also includes drain conduits 58 coupled to the same product filler auger outlets 59 at the base of the system. During operation of the clean in place system, the vacuum and drain conduits are alternately coupled to the auger outlets 59.

With respect to the drain, the clean in place system implements the following improvements. A drain system is provided that removes the water from the base of the filler hoppers and empties it directly into a drain 60 in the floor. The drain assembly is located at the base of the Bartelts for easy access.

Figure 7:
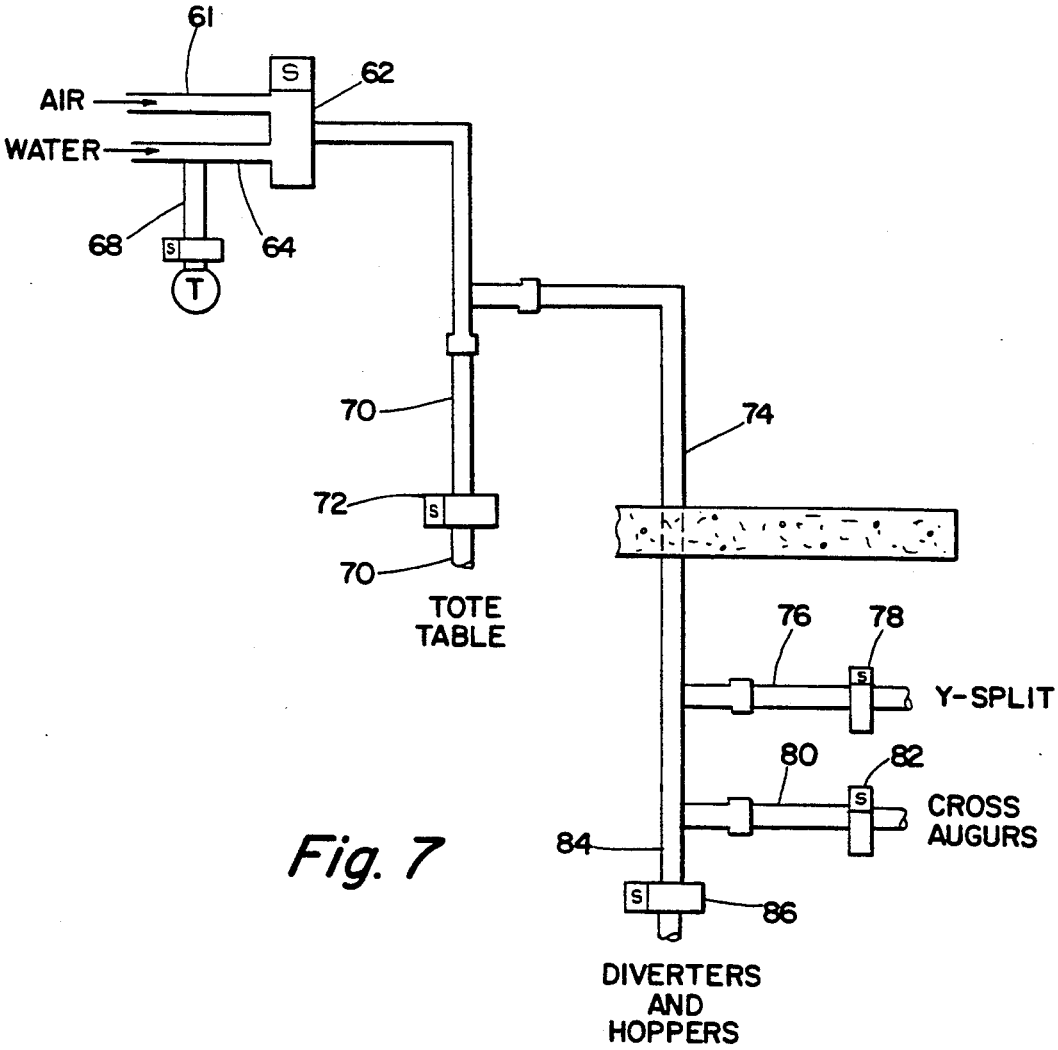
FIG. 7 illustrates one embodiment of the piping and valves for the spray nozzles to implement the clean in place system of the present invention.

FIGS. 3 and 7 illustrate the piping and valves for the several spray nozzles to implement the clean in place system of the present invention. Compressed air is introduced to one inlet 61 of a solenoid switched three-way valve 62, while hot water at approximately 180° from a Leslie constant temperature unit at the plant is introduced to a second inlet 64 of the three-way valve, which is switched by the solenoid 66 between either inlet. A discharge pipe 68 is provided before the second inlet to allow the inlet water temperature to reach 180° F. before it enters the three-way valve. A pipe and flexible hose 70 extends to the tote bin hopper barrel nozzle 32 through an on-off solenoid operated valve 72 located in that line. A second pipe 74 extends through the floor to a supply line 76 and an on-off solenoid operated valve 78 which leads to all the flush mounted internal nozzles of the Y-split, the cross augers, and the product diverter elements. A third pipe 80 extends to an on-off solenoid operated valve 82 and then to the internal nozzles 38 and 40 of the cross augers 20. A fourth pipe 84 extends to an on-off solenoid operated valve 86 and then to the spray nozzles 42 of the product diverters 24 and the four filler hopper barrel nozzles 34.

The controls for the clean in place system are capable of several functions:

1. Allow all or only some of the nozzles to have water or air directed therethrough at any time, as determined by the position of the three-way valve 62, and the state of operation of each of the solenoid operated on-off valves 72, 78, 82 and 86. This allows for the possibility of using all of the nozzles simultaneously, or of sequencing the flow of water through the system in a four stage sequence (e.g. run the tote table cleaning, followed by the Y-split, followed by the cross auger, followed by the diverters and product hoppers), as well as drying some areas longer than others.

2. Timers are included so that the system may be set up prior to a changeover, and the operator's only required action is to start the system.

3. Lights are visible to all operators even in different locations so that all personnel are aware of the stage that the system has reached at any time. FIG. 8 illustrates upper floor and lower floor light panels of a cleaning light system which informs packaging operators of the present status and phase of the clean in place system. The lights indicate:

Stage 1, evacuation of powder by air into the vacuum system;

Stage 2, completion of powder evacuation, waiting period until vacuum hoses are removed and drain hoses are connected;

Stage 3, washing of system with water;

Stage 4, drying of system with air;

Stage 5, completion of cycle.

Tests were conducted to determine how long the clean in place system equipment as described hereinabove would need to be sprayed and left to dry, and it was estimated that the entire system could be washed and dried in approximately 12 minutes.

The following clean in place system procedure is provided as being exemplary for the clean in place system:

Step 1: The tote operator removes the last tote bin when empty and then vacuums around the top of the tote table. Next, the tote operator places the spray nozzle plate over the opening, and then activates a light switch which indicates to the line operators that the nozzle is in position for cleaning the tote table.

Step 2: The packaging operators remove the two duck bills under each filler hopper, then connects the vacuum hoses. Compressed air is blown through all of the nozzles to dislodge and allow the removal of most of the powder product in the pouch filling center. The air can also be selectively sequenced through the nozzles to dislodge any remaining powder. During this step, all dislodged powder and residue is removed through vacuum outlets by vacuum hoses attached near the bases of the pouch filling center.

Step 3: The operators remove the vacuum hoses and secure the drain hoses to the base of the filler hoppers. The exiting end of the drain hose is placed into the drain beside the packaging line after compressed air cycle completed.

After this has been completed, the washing cycle is started by pressing a button. A light comes on, indicating the cycle has started.

The wash cycle starts with the following sequenced operation, the tote table being washed first, next the Y-split, next the cross augers, and then the diverter elements and filler hoppers. Once the washing is completed, the air is turned on automatically and uses the same cycle as the wash. The tote operator removes the spray nozzle when the air is activated. A light notifies the operator when this is to be done.

Step 4: While the system is being washed, the remainder of the duck bills are removed for cleaning, but are not cleaned immediately. Next, the operator starts vacuuming around the Bartelt where product has built up that could possibly fall into the pouches. Once the vacuuming is completed, the operator attaches a clean set of duck bills (second set).

Step 5: When the washing and drying cycles are completed, a light is activated to indicate to the tote operator that the spray nozzle is to be placed back into its holding bracket attached to the tote table. A new tote bin is then placed on top of the tote table.

Step 6: The line operators remove the drain hoses and wipe off any water that might cling to the opening at the base of the filler hopper.

Step 7: Start Bartelt pouch filling systems.

While several embodiments and variations of the present invention for a cleaning system for particulate handling equipment are described in detail herein, it should be apparent that the disclosure and teachings of the present invention will suggest many alternative designs to those skilled in the art.

What is claimed is:

1. A clean in place system for a system handling a flow of a dry product therethrough, comprising:

(a) a plurality of flow conduits through which a dry product flows;

(b) a plurality of spray nozzles, including spray nozzles located within said plurality of flow conduits;

(c) control means for the clean in place system including, (i) means for first introducing compressed air to be sprayed through said plurality of spray nozzles to dislodge and blow clean any dry product in the system, with vacuum means for removing air and any dry product dislodged, (ii) means for secondly introducing water to be sprayed through said plurality of spray nozzles to wash away any dry product remaining in the system with drain means for removing sprayed water and any product carried therewith, and (ii) means for thirdly introducing compressed air to be sprayed through said plurality of spray nozzles to blow out and evaporate any water remaining in the system after said second water spraying the step to dry the system.

2. A clean in place system for a system handling a flow of a dry product therethrough, as claimed in claim 1, wherein said plurality of spray nozzles includes a plurality of flush mounted spray nozzles mounted flush along the interior walls of said plurality of flow conduits.

3. A clean in place system for a system handling a flow of a dry product therethrough, as claimed in claim 2, wherein said handling system includes a tote table having a tote hopper, and said plurality of spray nozzles includes at least one spherical spray nozzle removably mounted within said tote hopper.

4. A clean in place system for a system handling a flow of a dry product therethrough, as claimed in claim 3, wherein at least one said spherical spray nozzle is mounted on a mounting plate which during a cleaning operation is placed temporarily over said tote hopper.

5. A clean in place system for a system handling a flow of a dry product therethrough, as claimed in claim 4, wherein a storage rack is positioned adjacent to said tote table to facilitate easy handling and temporary storage of said mounting plate and at least one said spherical spray nozzle.

6. A clean in place system for a system handling a flow of a dry product therethrough, as claimed in claim 5, wherein said spherical nozzle mounted on said mounting plate includes a flexible hose attached thereto to provide a supply of water and compressed air thereto.

7. A clean in place system for a system handling a flow of a dry product therethrough, as claimed in claim 3, wherein said handling system includes a plurality of filler hoppers, and said plurality of spray nozzles includes at least one spherical spray nozzle mounted within each of said plurality of filler hoppers.

8. A clean in place system for a system handling a flow of a dry product therethrough, as claimed in claim 7, wherein said handling system includes said tote hopper, a Y-split element, two cross augers, two diverter elements, two product outlets and two filler hoppers, wherein said tote hopper feeds dry product to said to Y-split element which splits the dry product and feeds said two cross augers, each of said diverter elements at each of said product outlets of each of said cross augers splits the flow of dry product and feed two of said plurality of filler hoppers at said product outlets of each of said diverter elements, and wherein said plurality of spray nozzles includes spray nozzles mounted in each of said Y-split elements, said cross augers, and said diverter elements.

9. A clean in place system for a system handling a flow of a dry product therethrough, as claimed in claim 1, wherein said vacuum means for removing air and any dry product carried therewith includes a vacuum conduit.

10. A clean in place system for a system handling a flow of a dry product therethrough, as claimed in claim 9, wherein said drain means for removing water and any product carried therewith includes a drain conduit.

11. A clean in place system for a system handling a flow of a dry product therethrough, as claimed in claim 10, wherein said vacuum conduit and drain conduit are alternately coupled.

12. A clean in place system for a system handling a flow of a dry product therethrough, as claimed in claim 1, wherein said means for first introducing compressed air to be sprayed through said plurality of nozzles includes means for sequencing the flow of compressed air first through at least one nozzle located near the top of the system, next through at least one nozzle located at an intermediate height in the system, and next through at least one nozzle located near said drain means.

13. A clean in place system for a system handling a flow of a dry product therethrough, as claimed in claim 12, wherein said means for secondly introducing water to be sprayed through said plurality of nozzles includes means for sequencing the flow of water first through at least one nozzle located near the top of said system, next through at least one nozzle located at an intermediate height in said system, and next through at least one nozzle located near said drain means.

14. A clean in place system for a system handling a flow of a dry product therethrough, as claimed in claim 1, wherein said means for secondly introducing water to be sprayed through said plurality of nozzles includes means for sequencing the flow of water first through at least one nozzle located near the top of said system, next through at least one nozzle located at an intermediate height in said system, and next through at least one nozzle located near said drain means.

15. A clean in place system for a system handling a flow of a dry product therethrough, comprising:

(a) a plurality of flow conduits through which a dry product flows;

(b) a plurality of spray nozzles, including spray nozzles located within said plurality of flow conduits, said spray nozzles located near the top of said system, spray nozzles located at an intermediate height in said system, and spray nozzles located near the base of said system;

(c) control means for the clean in place system including, means for introducing compressed air to be sprayed through said plurality of spray nozzles to dislodge and blow clean any dry product in said system, including means for sequencing the flow of compressed air first through at least one of said nozzles located near the top of said system, next through at least one of said nozzles located at an intermediate height in said system, and next through at least one of said nozzles located near the base of clean in place system; and (d) vacuum means for removing air and any dry product dislodged.

16. A clean in place system for a system handling a flow of a dry product therethrough, as claimed in claim 15 wherein said handling system includes a tote table with a tote hopper, a Y-split element, two cross augers, two diverter elements, two product outlets and two filler hoppers, wherein said tote hopper feeds dry product to said Y-split element, which splits the dry product and feeds said two cross augers, a diverter element at said product outlet of each of said cross auger which splits the flow of dry product and feeds said two filler hoppers at the outlets of each diverter element, and wherein said plurality of spray nozzles includes at least one of said spray nozzles mounted in all of said tote hopper, said Y-split element, said cross augers, said diverter elements, and said filler hoppers.

17. A clean in place system for a system handling a flow of a dry product therethrough, as claimed in claim 16, wherein said sequencing means sequences the flow of compressed air first through at least one of said flow nozzles in said tote hopper, next through at least one of said flow nozzles in said cross augers, and next through at least one of said flow nozzles in said diverter elements and said filler hoppers.

* * * * *